US009724739B2

(12) United States Patent
Shin et al.

(10) Patent No.: US 9,724,739 B2
(45) Date of Patent: Aug. 8, 2017

(54) GAP CONTROL DEVICE FOR PILGER DIE ASSEMBLY OF COLD PILGER MILLS

(71) Applicant: KEPCO NUCLEAR FUEL CO., LTD., Daejeon (KR)

(72) Inventors: Jung Cheol Shin, Daejeon (KR); In Kyu Kim, Daejeon (KR); Ki Bum Park, Daejeon (KR); Yong Shin Choi, Daejeon (KR); Ho Yeon Hwang, Daejeon (KR)

(73) Assignee: KEPCO NUCLEAR FUEL CO., LTD., Daejeon (KR)

( * ) Notice: Subject to any disclaimer, the term of this patent is extended or adjusted under 35 U.S.C. 154(b) by 338 days.

(21) Appl. No.: 14/526,588

(22) Filed: Oct. 29, 2014

(65) Prior Publication Data

US 2015/0306647 A1 Oct. 29, 2015

(30) Foreign Application Priority Data

Apr. 25, 2014 (KR) ..... 10-2014-0049933

(51) Int. Cl.
*B21B 31/30* (2006.01)
*B21B 31/16* (2006.01)
(Continued)

(52) U.S. Cl.
CPC ..... *B21B 21/02* (2013.01); *B21B 31/16* (2013.01); *B21B 31/30* (2013.01); *B21B 21/005* (2013.01)

(58) Field of Classification Search
CPC ..... B21B 21/005; B21B 21/02; B21B 31/16; B21B 31/30; B21B 31/00; B21B 31/02;
(Continued)

(56) References Cited

U.S. PATENT DOCUMENTS 199,459 A * 1/1878 Morgan ..... B21B 31/30 72/244
222,373 A * 12/1879 Bassett ..... B21B 31/30 279/87
(Continued)

FOREIGN PATENT DOCUMENTS

CN 201692989 U 1/2011
CN 202498083 U 10/2012
(Continued)

OTHER PUBLICATIONS

European Office Action issued Nov. 29, 2016.

*Primary Examiner* — Jimmy T Nguyen
*Assistant Examiner* — Gregory Swiatocha
(74) *Attorney, Agent, or Firm* — Rabin & Berdo, P.C.

(57) ABSTRACT

A gap control device for a Pilger die assembly of cold Pilger mills. The gap control device can independently control the height of a pair of bearing blocks which axially support an upper die. A lower plate has first and second receiving holes which respectively correspond to the upper portions of a pair of bearing blocks. First and second wedge plates are fitted into the receiving holes, and respectively have inclined surfaces on the upper portions thereof. First and second adjustment blocks respectively have inclined guide surfaces to be in surface contact with the inclined surfaces of the wedge plates, and are movable horizontally with respect to the lower plate. An upper plate is assembled to the upper portion of the lower plate to cover the adjustment blocks. First and second adjustment bolts allow the first and second adjustment blocks to be respectively manipulated in a horizontal direction.

5 Claims, 20 Drawing Sheets

(51) Int. Cl.
*B21B 21/02* (2006.01)
*B21B 21/00* (2006.01)

(58) Field of Classification Search
CPC ..... B21B 31/22; B21B 31/24; B21B 99/00; B21B 2271/02; B21B 2271/04
USPC ..... 72/208, 214, 240, 244, 248
See application file for complete search history.

(56) References Cited

U.S. PATENT DOCUMENTS

| | | | | | |
|---|---|---|---|---|---|
| 949,464 | A | * | 2/1910 | Dean | B21B 31/30 384/253 |
| 2,669,892 | A | * | 2/1954 | O'Malley | B21B 31/30 72/237 |
| 3,355,925 | A | * | 12/1967 | Barnikel | B21B 31/30 72/244 |
| 3,479,854 | A | * | 11/1969 | Stubbs | B21B 31/30 72/244 |
| 3,561,359 | A | * | 2/1971 | Cohen | B41F 3/28 100/168 |
| 2013/0042660 | A1 | | 2/2013 | Baensch et al. | |

FOREIGN PATENT DOCUMENTS

| | | | |
|---|---|---|---|
| DE | 19804162 | A1 | 12/1999 |
| KR | 93-009986 | B1 | 10/1993 |
| KR | 10-2000-0005310 | A | 1/2000 |
| KR | 10-0803025 | B1 | 2/2008 |
| KR | 10-2012-0000776 | A | 1/2012 |

* cited by examiner

GAP CONTROL DEVICE FOR PILGER DIE ASSEMBLY OF COLD PILGER MILLS

CROSS REFERENCE TO RELATED APPLICATION(S)

This application claims the benefit of Korean Patent Application No. 10-2014-0049933, filed on Apr. 25, 2014, entitled a gap control device for a Pilger die assembly of cold Pilger mills, which is hereby incorporated by reference in its entirety into this application.

BACKGROUND OF THE INVENTION

1. Field of the Invention

The present invention relates to a gap control device for a Pilger die assembly of cold Pilger mills, in general, to a gap control device which can independently control the height of a pair of bearing blocks which axially support an upper die.

2. Description of the Related Art

Cladding pipes of a nuclear fuel assembly serve to separate $UO_2$ pellets from coolant in the core, prevent a radiant fission product produced from the $UO_2$ pellets due to being discharged into the coolant, and prevent a chemical reaction between the coolant and the $UO_2$ pellets by separating the coolant and the $UO_2$ pellets from each other. Cladding pipes are made of a zircaloy or zirconium alloy that has superior corrosion resistance to the hot coolant and low neutron absorptivity.

Korean Laid-Open Patent Publication No. 10-1986-0005894 (dated Aug. 16, 1986) or Korean Laid-Open Patent Publication No. 10-2000-0005310 (dated Jan. 25, 2000) disclosed a process of fabricating cladding pipes. The process includes manufacturing an ingot by adding several alloy elements; manufacturing a pipe reduced extrusion (TREX) from the ingot by hot extrusion; and reducing the thickness and diameter of the TREX by repeating cold processing, referred to as Pilgering, and heat treatment processing, whereby a cladding pipe made of a Zr alloy is finally fabricated.

FIG. 1 is a configuration view showing a typical Pilgering apparatus for a cold milling process. The typical Pilgering apparatus includes a pair of rotatable Pilger dies 10 and a mandrel 20. The Pilger dies 10 transport a roll stand (or a saddle) 30 back and forth within a certain stroke range.

The mandrel 20 is inserted into a pipe 1 having a greater diameter, the pipe 1 being made of a Zr alloy. While the pipe 1 is being rotated and transported between the pair of Pilger dies 10, the inner diameter, the outer diameter, and the thickness of the pipe 1 are reduced by the Pilger dies 10 and the mandrel 20, whereby the pipe is fabricated into a pipe having certain dimensions through extrusion.

FIG. 2 is a side elevation view showing the typical Pilgering apparatus. The Pilger dies 11 and 12 consisting of the upper die 11 and the lower die 12 are rotatably assembled to the roll stand 30. The pipe is inserted in the working direction D between the upper and lower dies 11 and 12.

The upper die 11 is movable upwards and downwards perpendicularly to the working direction D, and a gap control device 40 for controlling a gap G between the upper and lower dies 11 and 12 is provided. Specifically, the gap control device 40 includes a first adjustment wedge 41 disposed on the upper die 11, a second adjustment wedge 42 which is in surface contact with the first adjustment wedge 41 along a slope inclined at a certain angle, and a spindle 43 is meshed with the second adjustment wedge 42, with both ends thereof being screwed into and supported by the roll stand 30.

In the gap control device 40, the second adjustment wedge 42 meshed with the spindle 43 moves back and forth in a horizontal direction following the direction in which the spindle 43 rotates. The first adjustment wedge 41 which is in surface contact with the second adjustment wedge 42 along the slope of a certain angle moves upwards and downwards depending on the horizontal position of the second adjustment wedge 42. In this fashion, the gap G between the upper and lower dies 11 and 12 is controlled, whereby the outer diameter of the pipe which is to be machined can be controlled.

FIG. 3 is a front elevation view showing the typical Pilgering apparatus.

Referring to FIG. 3, shafts 11*a* and 12*a* serving as drive shafts are axially provided in the upper die 11 and the lower die 12, respectively. The shafts 11*a* and 12*a* are supported by bearing blocks 31*a*, 31*b*, 32*a* and 32*b* such that the shafts 11*a* and 12*a* are freely rotatable.

The bearing blocks 31*a*, 31*b*, 32*a* and 32*b* consist of the pair of upper bearing blocks 31*a* and 31*b* and the pair of lower bearing blocks 31*a* and 31*b*. The upper bearing blocks 31*a* and 31*b* are provided on the roll stand 30 such that the upper bearing blocks 31*a* and 31*b* are movable with respect to the lower bearing blocks 32*a* and 32*b*. The gap control device 40 is disposed on the upper bearing blocks 31*a* and 31*b* and supported on the top end of the roll stand 30.

In the Pilgering apparatus of the related art, the gaps of the pair of upper bearing blocks 31*a* and 31*b* supporting the upper die 11 can be controlled by manipulating the gap control device 40 such that the gaps of the right and left bearing blocks are the same. There is a problem in that the gaps of the upper bearing blocks 31*a* and 31*b* cannot be controlled to be different.

In a specific example of the Pilgering apparatus which performs a Pilgering operation, the die on the ball stand is replaced with a die having a different size according to the size of pipes to be fabricated. When the replacement die is mounted, it is required to adjust the heights of the upper bearing blocks 31*a* and 31*b* to different values due to differing assembly tolerances.

However, the related-art gap control device 40 provided on the Pilgering apparatus can adjust the gap only within the range in which the heights of the upper bearing blocks 31*a* and 31*b* are the same. When differing assembly tolerances occur during the replacement, it is impossible to accurately align the die shafts.

The information disclosed in the Background of the Invention section is only for the enhancement of understanding of the background of the invention, and should not be taken as an acknowledgment or as any form of suggestion that this information forms a prior art that would already be known to a person skilled in the art.

RELATED ART DOCUMENT

Patent Document 1: United States Patent Application Publication No. 2013/0042660 (dated Feb. 21, 2013)

SUMMARY OF THE INVENTION

Accordingly, the present invention has been made keeping in mind the above problems occurring in the related art, and the present invention is intended to propose a gap control device in a Pilger die assembly of cold Pilger mills, in which the heights of a pair of bearing blocks can be controlled independently of each other.

In order to achieve the above object, according to one aspect of the present invention, there is provided a gap control device for a Pilger die assembly that includes: a lower plate having first and second receiving holes which respectively correspond to the upper portions of a pair of bearing blocks; first and second wedge plates fitted into the receiving holes, the wedge plates respectively having inclined surfaces on the upper portions thereof; first and second adjustment blocks respectively having inclined guide surfaces to be in surface contact with the inclined surfaces of the first and second wedge plates, the first and second adjustment blocks being movable horizontally with respect to the lower plate; an upper plate assembled to the upper portion of the lower plate to cover the first and second adjustment blocks; and first and second adjustment bolts with which the first and second adjustment blocks are to be respectively manipulated in a horizontal direction.

The lower or upper plate may further include bent guide wings to guide a horizontal movement of the first and second adjustment blocks.

The gap control device may further include a fixing block disposed in a central portion of the upper plate, with bolt heads of the first and second adjustment bolts fixed to the fixing block. More preferably, the fixing block may include: a head-fixing recess into which bolt heads of the first and second adjustment bolts are fixedly fitted; bolt recesses extending laterally from the head-fixing recess, the first and second adjustment bolts being seated in the bolt recesses; and auxiliary nut receiving recesses grooved inward from side surfaces of open ends of the bolt recesses.

The fixing block may further include catch portions protruding from both side portions, whereby the catch portions are seated and supported on the upper plate According to the present invention as set forth above, the gap control device for a Pilger die assembly of cold Pilger mills can adjust the heights of the pair of bearing blocks which support the upper die independently of each other. It is therefore possible to more accurately align die shafts when differing assembly tolerances occur during die replacement.

BRIEF DESCRIPTION OF THE DRAWINGS

The above and other objects, features and advantages of the present invention will be more clearly understood from the following detailed description when taken in conjunction with the accompanying drawings, in which.

DETAILED DESCRIPTION OF THE INVENTION

Specific structural and functional descriptions of certain embodiments of the present invention disclosed herein are only for illustrative purposes of the embodiments according to the idea of the present invention. The present invention may be embodied in many different forms without departing from the spirit and significant characteristics of the present invention. The present invention is intended to cover not only the exemplary embodiments, but also various alternatives, modifications, equivalents and other embodiments that may be included within the spirit and scope of the present invention as defined by the appended claims.

It will be understood that, although the terms "first," "second," etc. may be used herein to describe various elements, these elements should not be limited by these terms. These terms are only used to distinguish one element from another element. For instance, a first element discussed below could be termed a second element without departing from the teachings of the present invention. Similarly, the second element could also be termed the first element.

It will be understood that when an element is referred to as being "coupled" or "connected" to another element, it can be directly coupled or connected to the other element or intervening elements may be present therebetween. In contrast, it should be understood that when an element is referred to as being "directly coupled" or "directly connected" to another element, there are no intervening elements present. Other expressions that explain the relationship between elements, such as "between," "directly between," "adjacent to," or "directly adjacent to," should be construed in the same way.

Unless otherwise defined, all terms including technical and scientific terms used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Embodiments of the present invention will now be described in detail with reference to the accompanying drawings.

Figure 1:
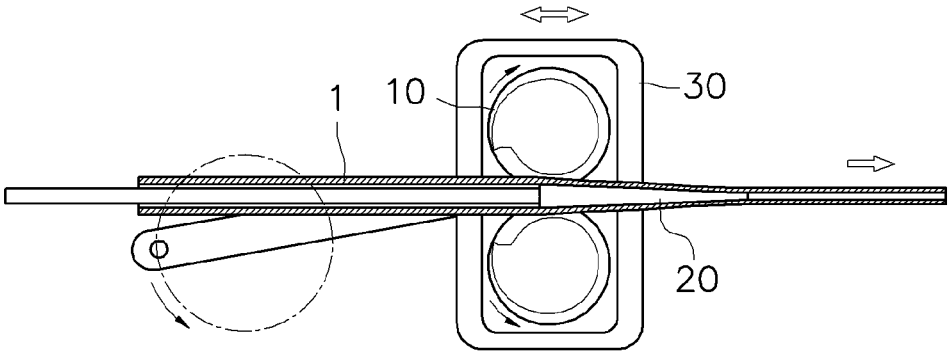
FIG. 1 is a schematic configuration view showing a typical Pilgering apparatus.
Figure 2:
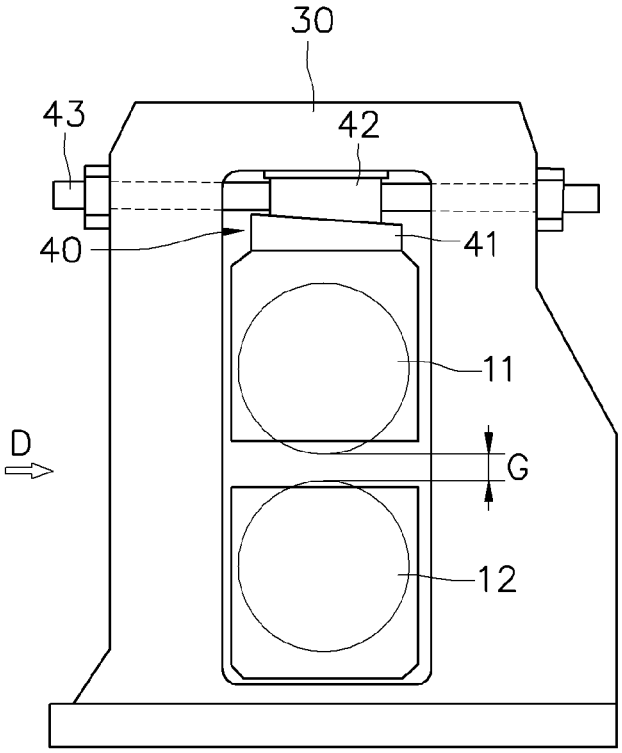
FIG. 2 is a side elevation view showing the typical Pilgering apparatus.
Figure 3:
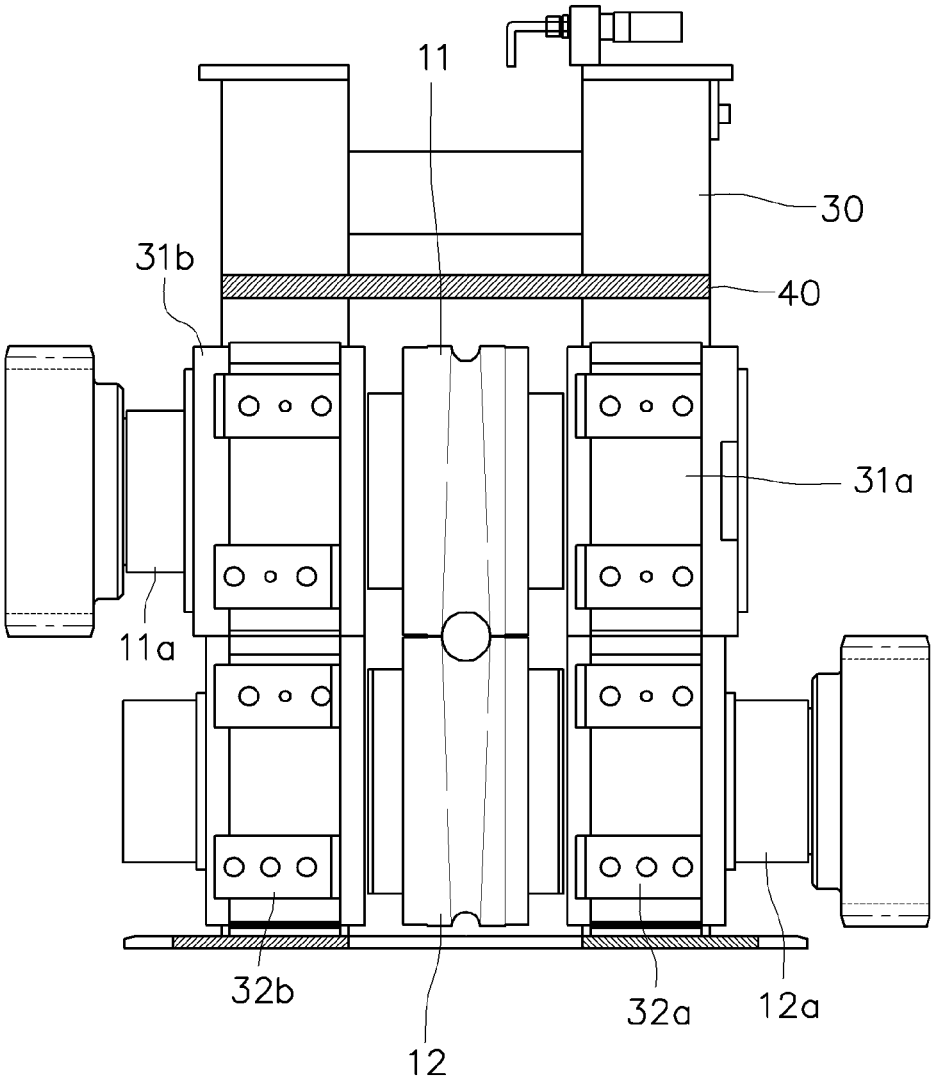
FIG. 3 is a front elevation view showing the typical Pilgering apparatus.
Figure 4:
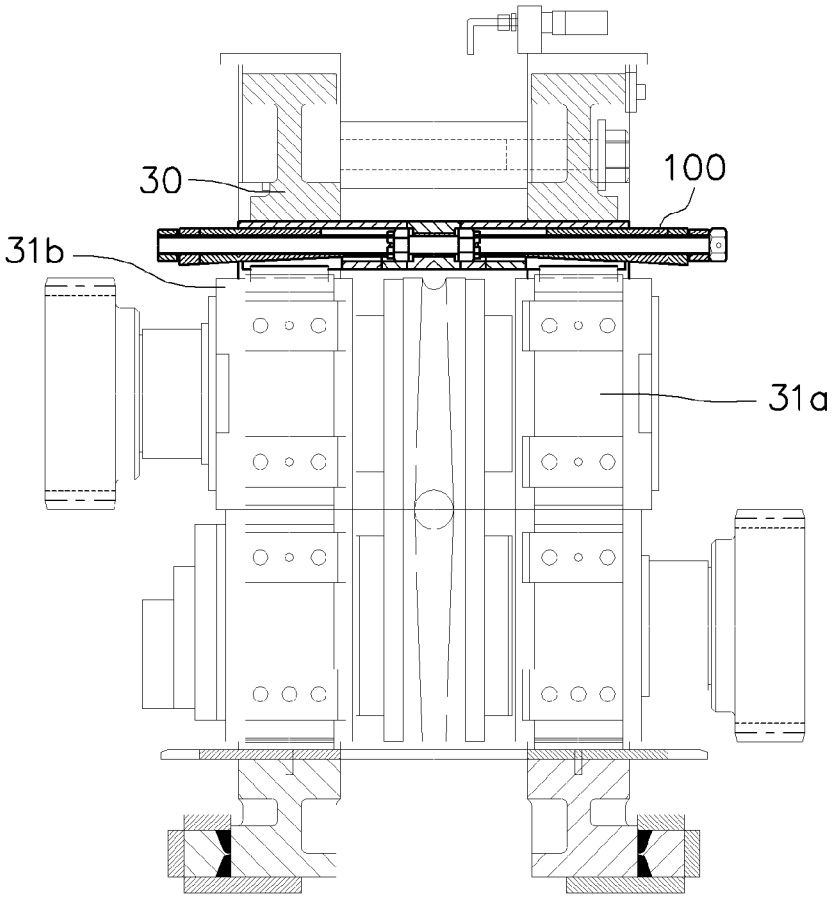
FIG. 4 is a front elevation view showing a Pilgering apparatus provided with a gap control device according to an exemplary embodiment of the present invention.

FIG. 4 is a front elevation view showing a Pilgering apparatus provided with a gap control device 100 according to an exemplary embodiment of the invention. The gap control device 100 is disposed between a pair of upper bearing blocks 31*a* and 31*b* and a roll stand 30, with the upper die thereof being axially mounted on the pair of upper bearing blocks 31*a* and 31*b*, such that the gaps of the two upper bearing blocks 31*a* and 31*b* can be controlled independently of each other.

Figure 5:
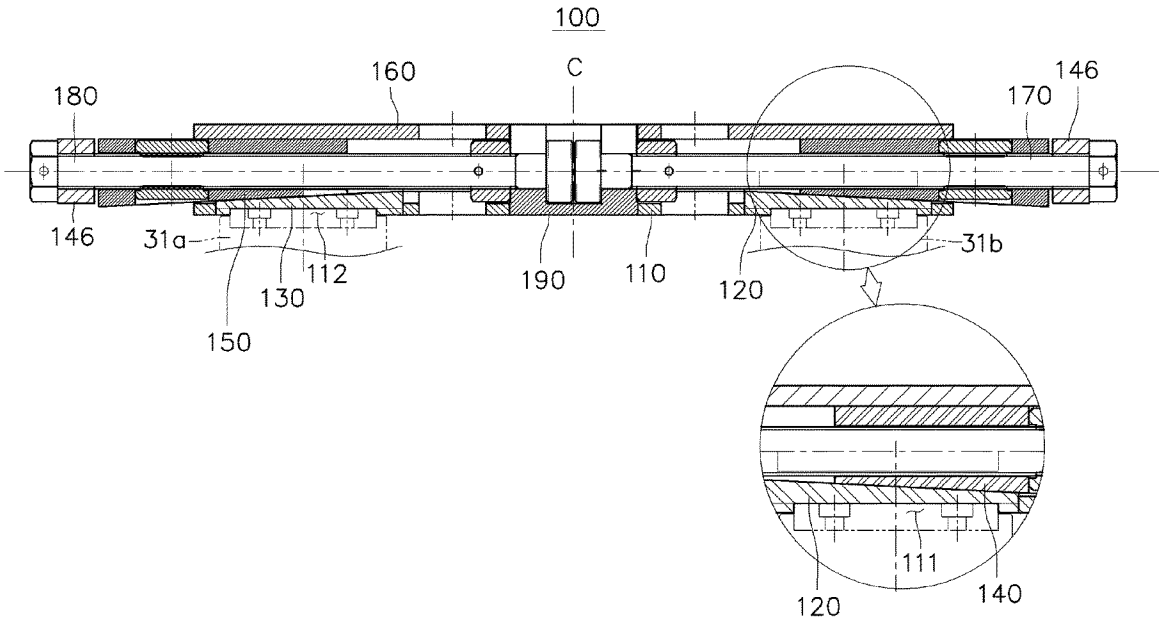
FIG. 5 is a cross-sectional view showing the configuration of the gap control device according to an exemplary embodiment of the present invention.

Specifically, FIG. 5 is a cross-sectional view showing the configuration of the gap control device 100 according to an exemplary embodiment of the invention. In FIG. 5, the gap control device 100 is mirror-symmetrical about the center line C.

As shown in FIG. 5, the gap control device 100 includes: a lower plate 110 having first and second receiving holes 111 and 112 which respectively correspond to the upper portions of the pair of bearing blocks 31*a* and 31*b*; first and second wedge plates 120 and 130 fitted into the receiving holes 111 and 112, the wedge plates 120 and 130 respectively having inclined surfaces on the upper portions thereof; first and second adjustment blocks 140 and 150 respectively having inclined guide surfaces to be in surface contact with the inclined surfaces of the first and second wedge plates 120 and 130, the first and second adjustment blocks 140 and 150 being movable horizontally with respect to the lower plate 110; an upper plate 160 assembled to the upper portion of the lower plate 110 to cover the first and second adjustment blocks 140 and 150; and first and second adjustment bolts 170 and 180 with which the first and second adjustment blocks 140 and 150 are to be respectively manipulated in a horizontal direction.

The first and second adjustment bolts 170 and 180 are independently manipulated so that the first and second adjustment blocks 140 and 150 are respectively displaced back and forth with respect to the adjustment bolts 170 and 180 in response to the rotation of the adjustment bolts 170 and 180. This consequently adjusts the heights of the first and second wedge plates 120 and 130, the inclined surfaces of which are in surface contact with the corresponding adjustment blocks 140 and 150. In response to the height control over the wedge plates 120 and 130, the heights of the bearing blocks 31*a* and 31*b* corresponding to the respective wedge plates are adjusted, so that the left and right gaps between the upper and lower dies can be independently controlled.

Figure 6A:
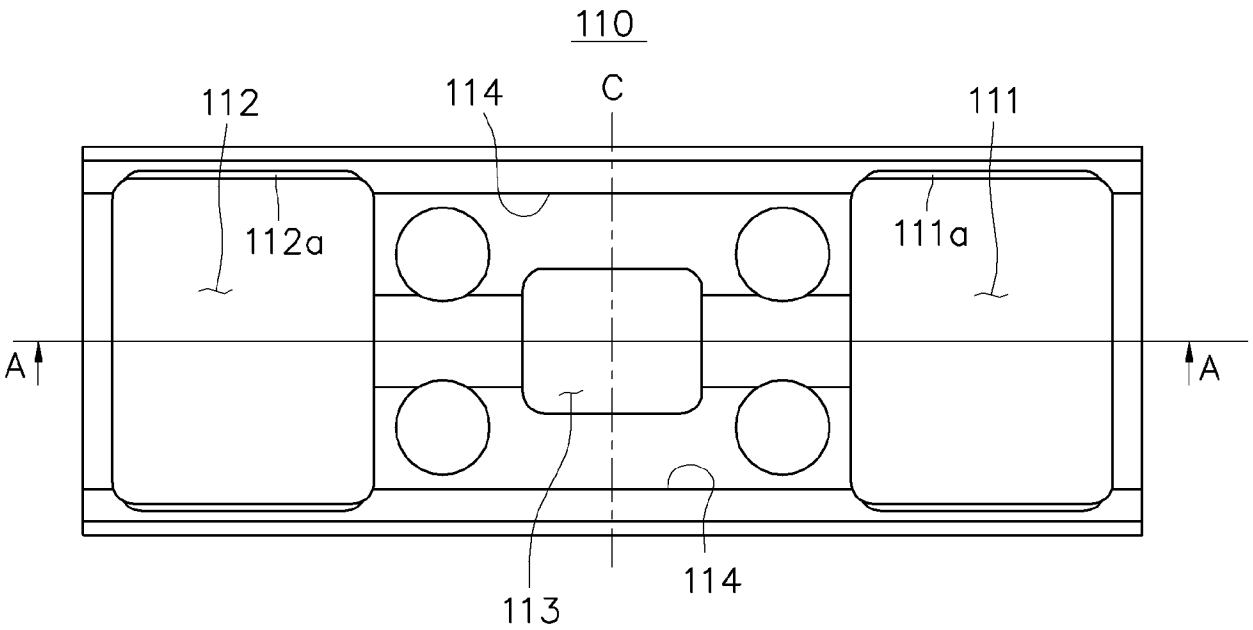
FIG. 6A and FIG. 6B are top-plan and side elevation views showing the lower plate of the gap control device shown in FIG. 5.
Figure 6B:
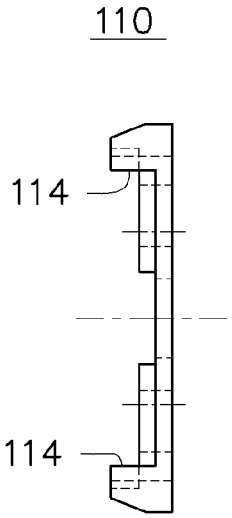
Figure 6C:
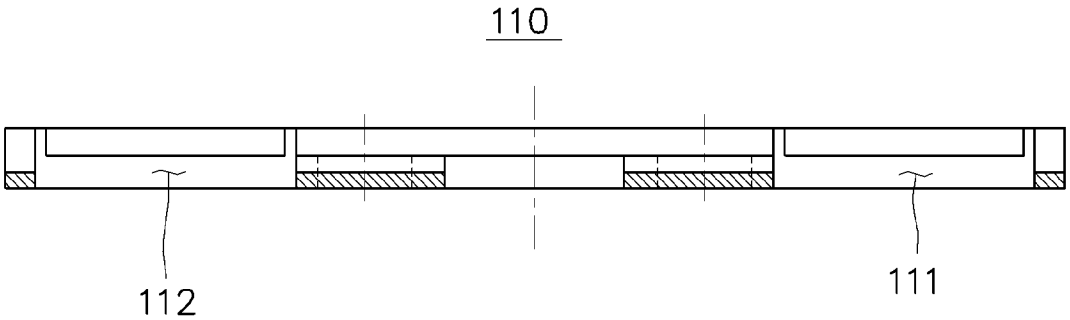
FIG. 6C is a cross-sectional view taken along line C-C of FIG. 6A.

FIGS. 6A and 6B are top-plan and side elevation views showing the lower plate of the gap control device 100, and FIG. 6C is a cross-sectional view taken along line C-C of FIG. 6A.

Referring to FIGS. 6A to 6C, the lower plate 110 has the shape a substantially-rectangular plate, with the first and second receiving holes 111 and 112 penetrating through the right and left portions thereof. The first and second receiving holes 111 and 112 are mirror images to each other. The first and second wedge plates 120 and 130 are seated in the first and second receiving holes 111 and 112 such that they respectively correspond to the pair of bearing blocks 31*a* and 31*b*.

The first and second receiving holes 111 and 112 are respectively provided with engaging steps 111*a* and 112*a* which extend inward. When the wedge plates 120 and 130 are placed into the receiving holes 111 and 112, the wedge plates 120 and 130 can be securely seated inside the receiving holes 111 and 112.

A substantially rectangular through-hole 113 is formed in the central portion of the lower plate 110. A fixing block 190 is seated in the through-hole 113 to support the inner ends of the first and second adjustment bolts 170 and 180, such that the first and second adjustment bolts 170 and 180 can be manipulated to rotate.

The lower plate 110 is provided on both ends thereof with guide wings 114 to guide the first and second adjustment blocks 140 and 150 which horizontally move along the upper part of the lower plate 110.

Figure 7A:
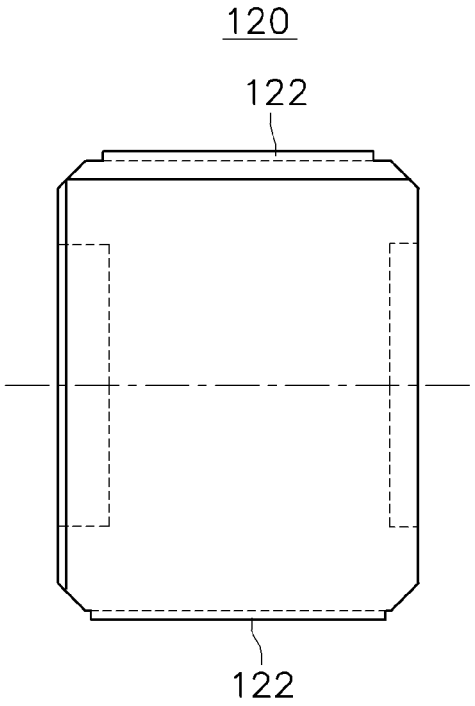
FIG. 7A, FIG. 7B and FIG. 7C are top-plan, side elevation and front elevation views showing the wedge plate of the gap control device shown in FIG. 5.
Figure 7B:
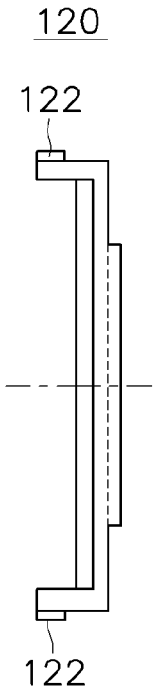
Figure 7C:
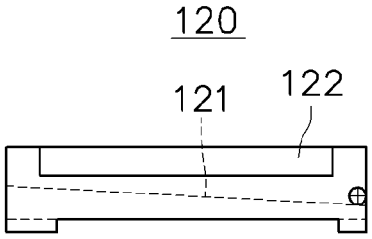

FIG. 7A, FIG. 7B and FIG. 7C are top-plan, side elevation and front elevation views showing one wedge plate 120 of the gap control device 100 shown in FIG. 5. According to this exemplary embodiment of the invention, the first and second wedge plates 120 and 130 have the same shape. In the following, a description will be given of the first wedge plate 120, but a description of the second wedge plate 130 will be omitted.

As shown in FIGS. 7A to 7C, the first wedge plate 120 is configured as a rectangular plate that is to be seated in the first receiving hole 111 of the lower plate 110, with the inclined surface 121 being formed at a preset angle on the top surface of the wedge plate 120.

The first wedge plate 120 has catch portions 122 on both ends. The catch portions 122 serve to support the lower end of the first wedge plate 120 when the first wedge plate 120 is seated in the first receiving hole 111 of the lower plate 110. For example, the catch portions 122 can be seated on top of the engaging steps 111*a* of the lower plate 110 (see FIG. 6) such that the first wedge plate 120 can be assembled to the lower plate 110 while being seated in the first receiving hole 111 of the lower plate 110.

Figure 8A:
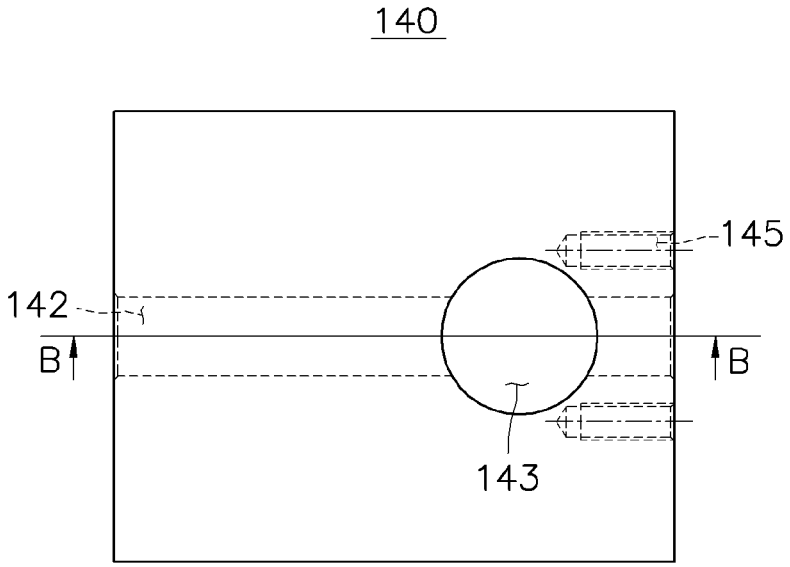
FIG. 8A and FIG. 8B are top-plan and side elevation views showing the adjustment block of the gap control device shown in FIG. 5.
Figure 8B:
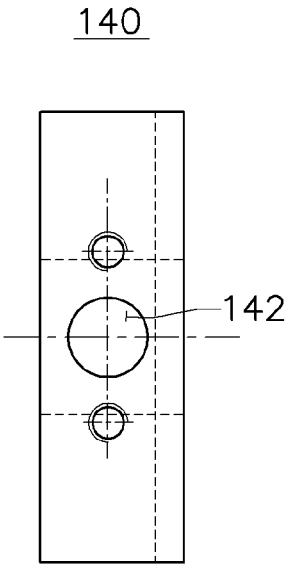
Figure 8C:
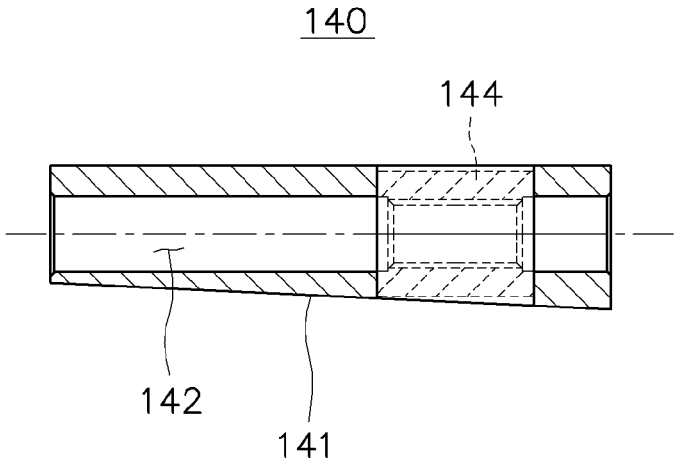
FIG. 8C is a cross-sectional view taken along line B-B of FIG. 8A.
Figure 8D:
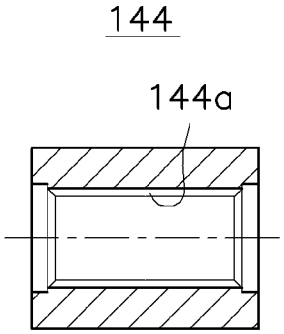
FIG. 8D is a cross-sectional view showing the configuration of the nut.

FIG. 8A and FIG. 8B are top-plan and side elevation views showing one adjustment block 140 of the gap control device 100 shown in FIG. 5, FIG. 8C is a cross-sectional view taken along line B-B of FIG. 8A, and FIG. 8D is a cross-sectional view showing the configuration of a nut 144. According to this exemplary embodiment of the invention, the first and second adjustment blocks 140 and 150 have the same shape. In the following, a description will be given of the first adjustment block 140, but a description of the second adjustment block 150 will be omitted.

As shown in FIGS. 8A to 8D, the first adjustment block 140 has the shape of a hexahedral block, with the inclined guide surface 141 being formed on the bottom surface which is to be in surface contact with the top surface of the first wedge plate 120. The inclined guide surface 141 is inclined at the same angle as the inclined surface 121 of the first wedge plate 120. The first adjustment block 140 also has an axis hole 142 which extends in a lateral direction and into which the adjustment bolt 170 is fitted.

The first adjustment block 140 also has an assembly hole 143 which perpendicularly intersects the axis hole 142. The nut 144 having threads 144*a* on the inner circumference is assembled into the assembly hole 143, such that the first adjustment bolt 170 assembled into the axis hole 142 can be meshed with the nut 144.

It is illustrated in this embodiment that the first adjustment block 140 is provided with the nut 144 having the threads which is meshed with the first adjustment bolt 170. However, according to an alternative embodiment, female threads can be formed directly in the axis hole 142 of the first adjustment block 140 such that the first adjustment bolt 170 can be meshed with the axis hole 142.

The first adjustment block 140 may have a first stopper plate (146; see FIG. 9A and FIG. 9B) which can limit the range in which the first adjustment block 140 can move. The first stopper plate 146 can be assembled to the first adjustment block 140 with bolts. In FIG. 8A, reference numeral 145 indicates bolt holes into which bolts are fitted to assemble the stopper plate to the adjustment block 140.

Figure 9A:
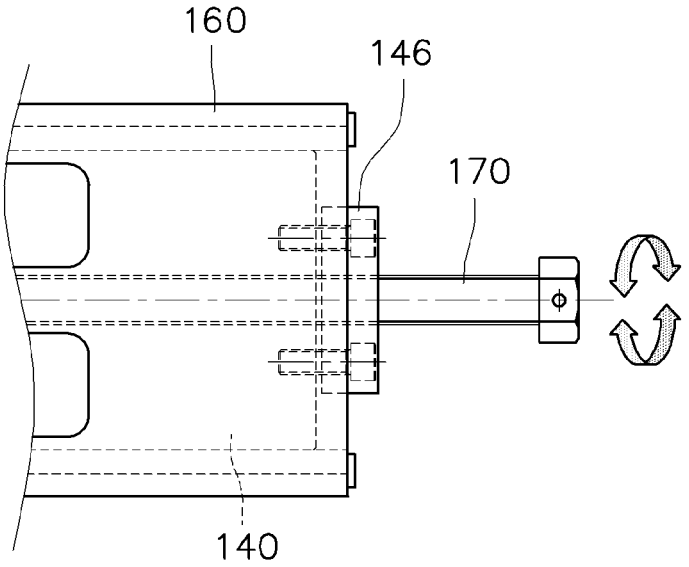
FIG. 9A and FIG. 9B are views showing an example of the operation of the gap control device according to an exemplary embodiment of the present invention.
Figure 9B:
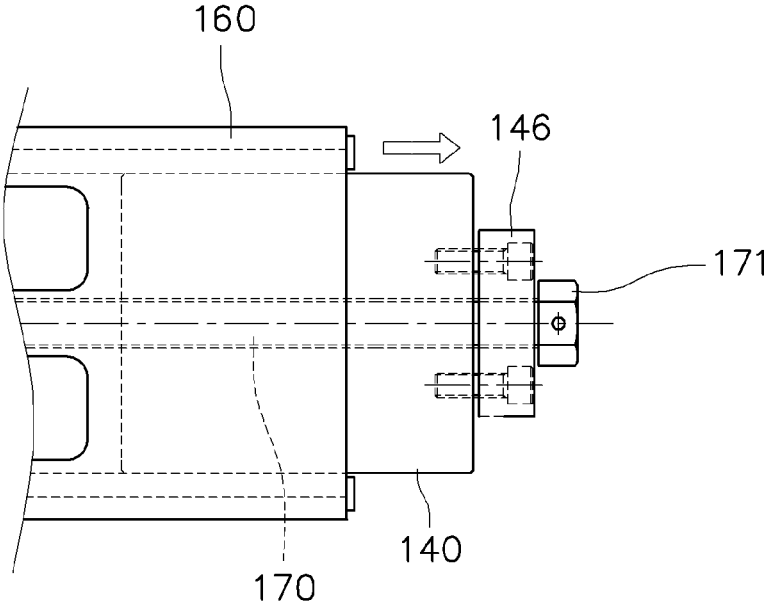

Specifically, FIG. 9A and FIG. 9B show an example of the operation of the gap control device according to an exemplary embodiment of the invention. When the first adjustment bolt 170 is manipulated to rotate, the first adjustment block 140 moves laterally. The height of the first wedge plate 120, which is positioned under the first adjustment block 140 and is in surface contact with the first adjustment block 140 via the inclined surfaces, is adjusted according to the position of the first adjustment block 140. The first stopper plate 146 is assembled to one end of the first adjustment block 140 with bolts. When the first stopper plate 146 moves to the right along with the first adjustment block 140 in response to the first adjustment bolt 170 being manipulated, the range in which the stopper plate 146 can move to the right is limited to a position where the first stopper plate 146 butts against a first fixing nut 171 of the first adjustment bolt 170.

The first stopper plate 146 is assembled to the first adjustment block 140 with bolts. It is therefore possible to control the range in which the first adjustment block 140 can move by adjusting the bolt-fastening length of the first adjustment block 140 in consideration of the gap adjustment range of the die.

Figure 10A:
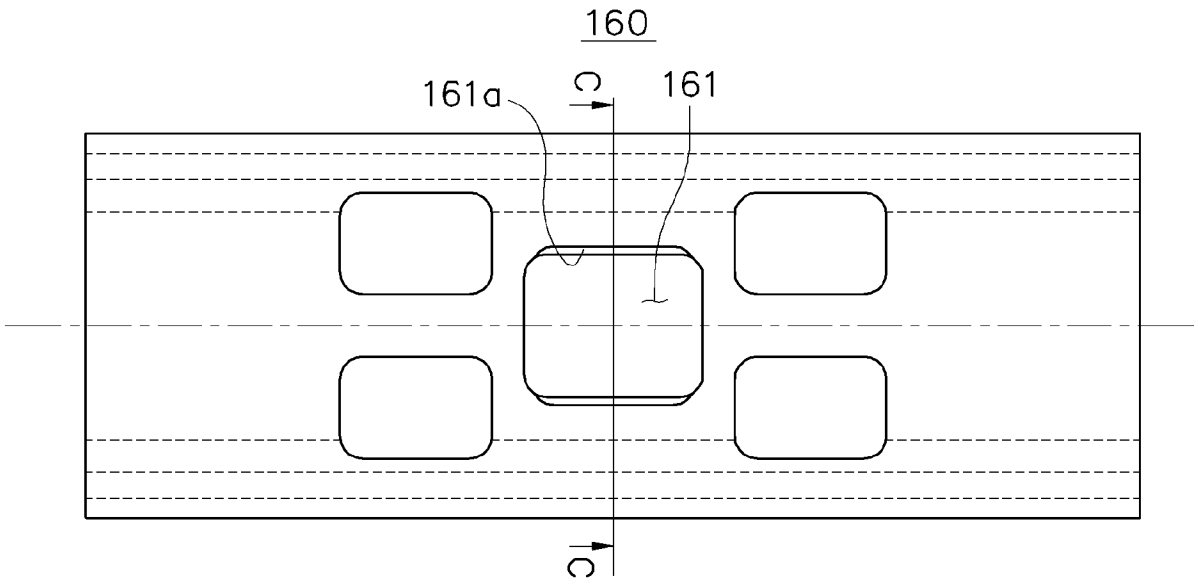
FIG. 10A is a top-plan view showing the upper plate of the gap control device shown in FIG. 5.
Figure 10B:
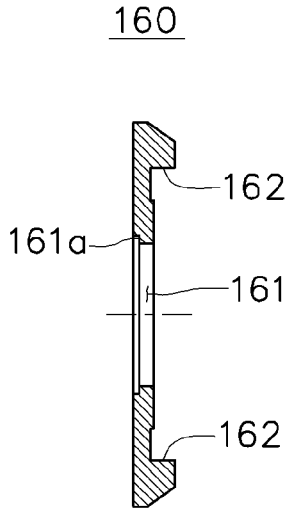
FIG. 10B is a cross-sectional view taken along line C-C of FIG. 10A.
Figure 10C:
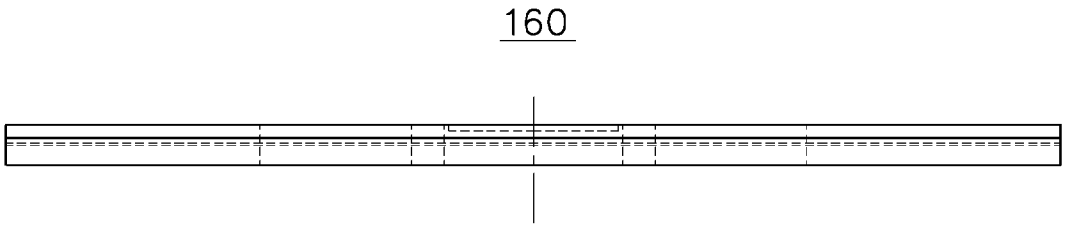
FIG. 10C is a front elevation view of FIG. 10A.

FIG. 10A is a top-plan view showing the upper plate of the gap control device shown in FIG. 5. FIG. 10B is a cross-sectional view taken along line C-C of FIG. 10A. FIG. 10C is a front elevation view of FIG. 10A.

Referring to FIGS. 10A to 10C, the upper plate 160 has the shape of a rectangular plate, the size of which is the same as that of the lower plate 110. The upper plate 160 has an assembly hole 161 in the central portion to which the fixing block 190 is assembled. The inner ends of the first and second adjustment bolts 170 and 180 are fixedly supported to the upper plate 160 via the fixing block 190.

The assembly hole 161 has an engaging step 161*a*, and when the fixing block 190 fitted into the assembly hole 161, it is seated in the assembly hole 161 by being supported on the engaging step 161*a*.

The upper plate 160 has guide wings 162 at both ends, the guide wings 162 being bent downward. The first and second adjustment blocks 140 and 150 can move horizontally by being guided between the two guide wings 162.

Figure 11A:
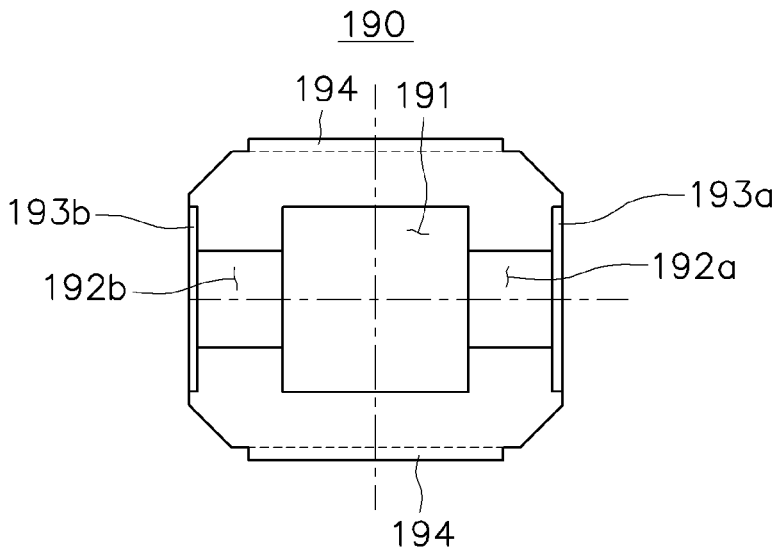
FIG. 11A, FIG. 11B and FIG. 11C are top-plan, side elevation and front elevation views showing the fixing block of the gap control device shown in FIG. 5.
Figure 11B:
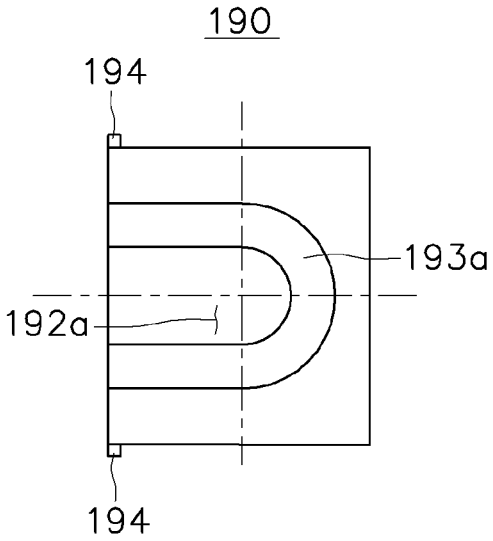
Figure 11C:
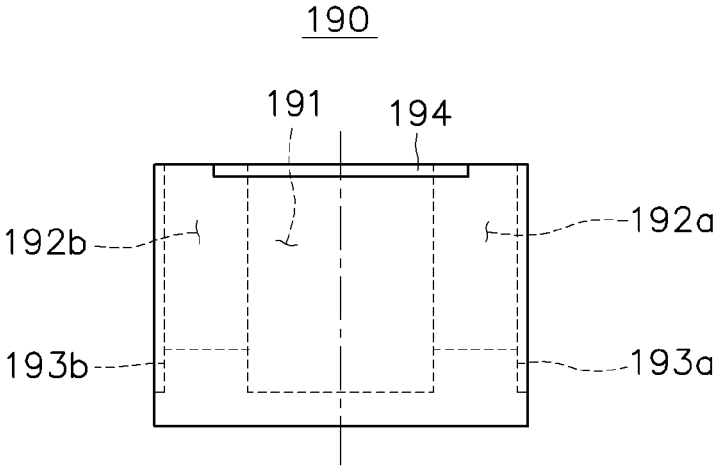

FIG. 11A, FIG. 11B and FIG. 11C are top-plan, side elevation and front elevation views showing the fixing block 190 of the gap control device 100 shown in FIG. 5.

Referring to FIGS. 11A to 11C, the fixing block 190 has the shape of a substantially hexahedral block. The fixing block 190 has a head-fixing recess 191 into which bolt heads of the first and second adjustment bolts 170 and 180 are fixedly fitted, bolt recesses 192*a* and 192*b* extending laterally from the head-fixing recess 191, the adjustment bolts being seated in the bolt recesses 192*a* and 192*b*, and auxiliary nut receiving recesses 193*a* and 193*b* grooved inward from the side surfaces of the open ends of the bolt recesses 192*a* and 192*b*.

The fixing block 190 also has catch portions 194 protruding from both side portions of the upper end. The catch portions 194 are supported on the engaging step 161*a* of the upper plate (see FIGS. 10A and 10B), such that the fixing block 190 is seated on and assembled to the lower plate 110.

Figure 12:
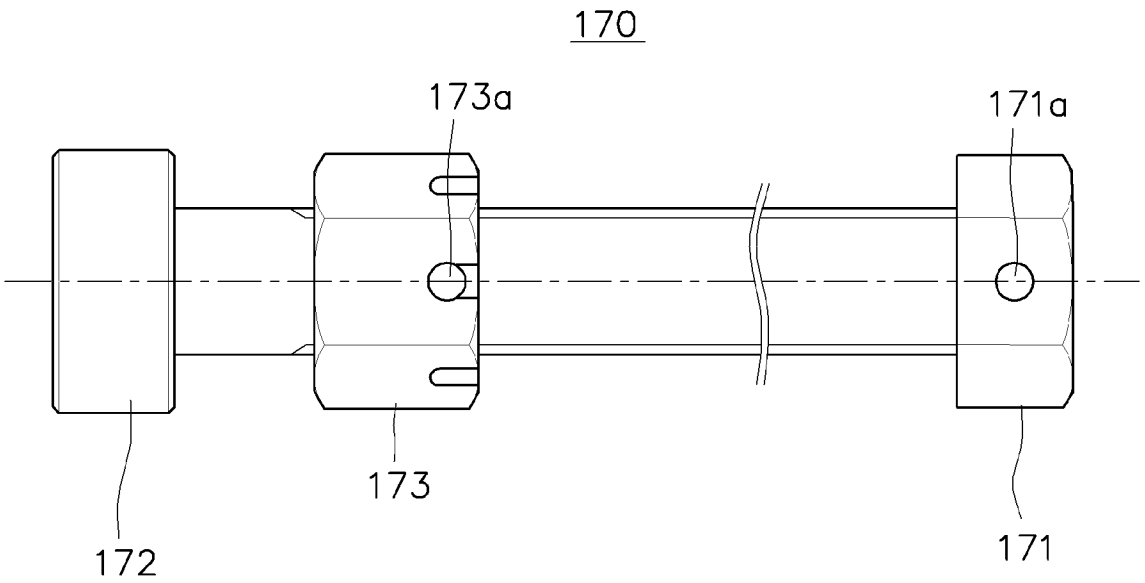
FIG. 12 is a view showing the adjustment bolt of the gap control device shown in FIG. 5.

FIG. 12 is a view showing the adjustment bolt 170 of the gap control device shown in FIG. 5. According to this exemplary embodiment of the invention, the first and second adjustment bolts 170 and 180 have the same shape. In the following, a description will be given of the first adjustment bolt 170, but a description of the second adjustment bolt 180 will be omitted.

Referring to FIG. 12, the first adjustment bolt 170 has the first fixing nut 171 on one end and a first bolt head 172 on the other end. A first auxiliary nut 173 is fixed at a position adjacent to the first bolt head 172.

It is preferable that the first bolt head 172 is integrated to the first adjustment bolt 170, whereas the first fixing nut 171 and the first auxiliary nut 173 can be meshed with the first adjustment bolt 170 and subsequently fixed to the first adjustment bolt 170 with fixing pins 171*a* and 173*a*.

Referring to FIGS. 11A to 11C together with FIG. 12, the first bolt head 172 is fitted into the head-fixing recess 191, and the first adjustment bolt 170 is positioned and seated in the first bolt recess 192*a*. The first auxiliary nut 173 is located at a position adjoining to the first receiving recess 193*a*. The first adjustment bolt 170 can be manipulated to rotate, with the first bolt head 172 being fixed in position with respect to the upper plate 160.

Figure 13:
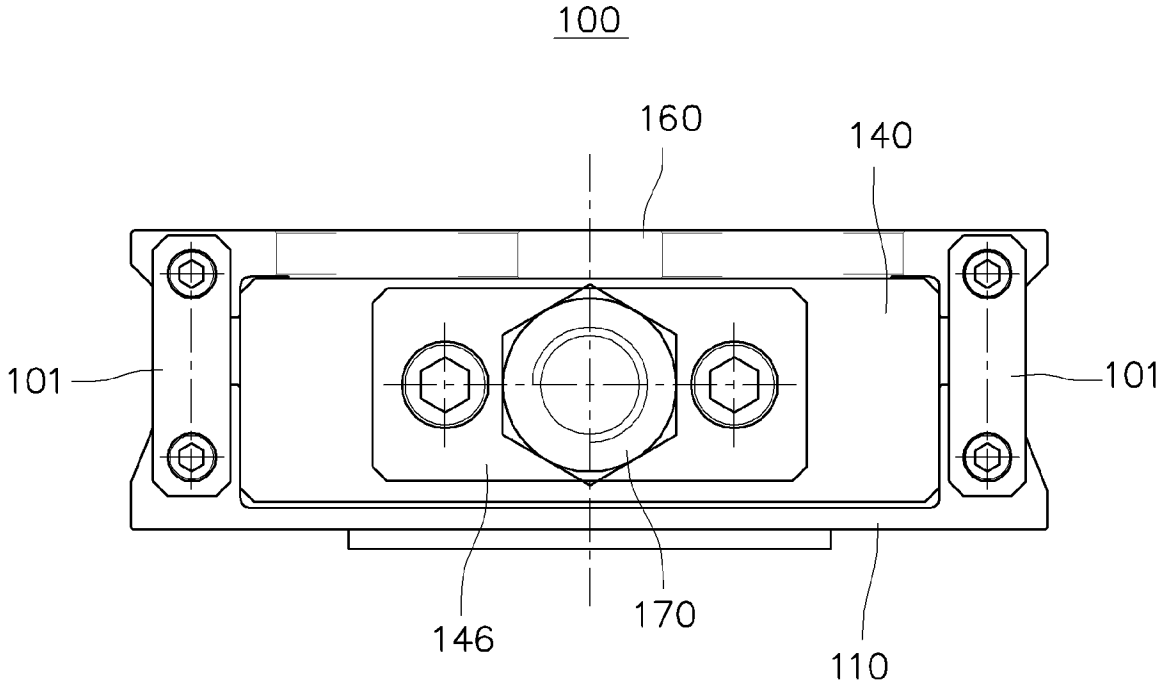
FIG. 13 is a right side-elevation view showing the gap control device according to an exemplary embodiment of the invention.

FIG. 13 is a right side-elevation view showing the gap control device 100 according to an exemplary embodiment of the invention.

The gap control device 100 according to this embodiment can further include a plurality of fixing brackets 101 which are bolt-assembled to the lower and upper plates 110 and 160, thereby connecting the plates 110 and 160 to each other.

Although the exemplary embodiments of the present invention have been described for illustrative purposes, those skilled in the art will appreciate that various modifications, additions and substitutions are possible, without departing from the scope and spirit of the present invention as disclosed in the accompanying claims.

What is claimed is:

1. A gap control device for a Pilger die assembly, comprising:

a lower plate having a first receiving hole formed in a first side portion of the lower plate which corresponds to an upper portion of a first bearing block, a second receiving hole formed in a second side portion of the lower plate which corresponds to an upper portion of a second bearing block, and a fixing block hole formed in a central portion of the lower plate;

a first wedge plate fitted into the first receiving hole, and a second wedge plate fitted into the second receiving hole, wherein the first and second wedge plates, respectively, have inclined surfaces on upper portions thereof;

a first adjustment block configured to move on the first wedge plate, and a second adjustment block configured to move on the second wedge plate, wherein the first and second adjustment blocks, respectively, have inclined guide surfaces on bottom surfaces thereof and the inclined guide surfaces of the first and second adjustment blocks slidingly contact with the inclined surfaces of the first and second wedge plates, respectively;

an upper plate assembled to an upper portion of the lower plate to cover the first and second adjustment blocks, the upper plate having an assembly hole formed in a central portion thereof which corresponds to the fixing block hole of the lower plate;

a first adjustment bolt coupled with the first adjustment block and configured to move the first adjustment block in a horizontal direction, and a second adjustment bolt coupled with the second adjustment block and configured to move the second adjustment block in the horizontal direction, wherein the first adjustment bolt is arranged on the same axial center as that of the second adjustment bolt; and a fixing block seated in the fixing block hole of the lower plate and supporting one end of each of the first and second adjustment bolts.

2. The gap control device according to claim 1, wherein the lower or upper plate further comprises bent guide wings to guide a horizontal movement of the first and second adjustment blocks.

3. The gap control device according to claim 1, wherein the fixing block comprises:

a head-fixing recess into which bolt heads coupled to said one end of each of the first and second adjustment bolts are fixedly fitted;

bolt recesses extending laterally from the head-fixing recess such that the first and second adjustment bolts are seated in the bolt recesses; and auxiliary nut receiving recesses grooved inward from side surfaces of open ends of the bolt recesses such that auxiliary nuts are seated in the auxiliary nut receiving recesses.

4. The gap control device according to claim 1, wherein the fixing block further comprises catch portions protruding from both sides of an upper portion of the fixing block, whereby the catch portions are seated and supported on the upper plate.

5. The gap control device according to claim 3, wherein the fixing block further comprises catch portions protruding from both sides of an upper portion of the fixing block, whereby the catch portions are seated and supported on the upper plate.

* * * * *